US007604431B2

(12) United States Patent
Fournier

(10) Patent No.: US 7,604,431 B2
(45) Date of Patent: Oct. 20, 2009

(54) INTERLOCKING GROUND COVER MATS

(75) Inventor: Bob Fournier, Edmonton (CA)

(73) Assignee: Maxximat Inc., Edmonton, Alberta (CA)

( * ) Notice: Subject to any disclaimer, the term of this patent is extended or adjusted under 35 U.S.C. 154(b) by 54 days.

(21) Appl. No.: 11/566,549

(22) Filed: Dec. 4, 2006

(65) Prior Publication Data

US 2008/0075533 A1 Mar. 27, 2008

(51) Int. Cl.
*E01C 5/00* (2006.01)

(52) U.S. Cl. ..... 404/35; 404/40; 404/41

(58) Field of Classification Search ..... 404/41, 404/34, 35, 36, 40
See application file for complete search history.

(56) References Cited

U.S. PATENT DOCUMENTS

| | | | | | |
|---|---|---|---|---|---|
| 2,315,180 | A | | 3/1943 | Arthur | |
| 2,316,232 | A | * | 4/1943 | Fischer | 52/309.13 |
| 2,335,556 | A | * | 11/1943 | Wilson | 404/36 |
| 2,635,450 | A | * | 4/1953 | Orzel | 52/582.1 |
| 2,737,093 | A | * | 3/1956 | Greulich | 404/4 |
| 2,942,535 | A | * | 6/1960 | Spangler | 404/35 |
| 3,078,621 | A | * | 2/1963 | Hinds | 52/99 |
| 3,469,509 | A | * | 9/1969 | Hutchinson | 404/41 |
| 3,500,606 | A | * | 3/1970 | Wharmby | 52/591.1 |
| 3,602,110 | A | * | 8/1971 | Wiggins | 404/40 |
| 3,671,063 | A | | 6/1972 | Slayden | |
| 4,250,828 | A | * | 2/1981 | Cota | 114/307 |
| 4,462,712 | A | * | 7/1984 | Penland, Sr. | 404/36 |
| 4,499,967 | A | * | 2/1985 | Anderson | 182/222 |
| 4,965,903 | A | | 10/1990 | Bish | |
| 5,022,200 | A | | 6/1991 | Wilson et al. | |
| 5,054,255 | A | | 10/1991 | Maninfior | |
| 5,161,268 | A | * | 11/1992 | Harrow | 5/201 |
| 5,702,208 | A | * | 12/1997 | Hilfiker et al. | 405/302.4 |
| 6,089,784 | A | * | 7/2000 | Ardern | 404/41 |
| 6,185,893 | B1 | * | 2/2001 | Gaston | 52/385 |
| 6,595,566 | B1 | * | 7/2003 | Donnan | 294/16 |
| 6,733,206 | B2 | | 5/2004 | Stasiewich et al. | |
| 6,966,161 | B2 | * | 11/2005 | Palsson et al. | 52/589.1 |
| 7,162,838 | B2 | * | 1/2007 | Ardern | 52/127.9 |
| 2002/0174961 | A1 | * | 11/2002 | Anderson et al. | 160/178.1 R |
| 2005/0117969 | A1 | * | 6/2005 | Byrne et al. | 404/19 |
| 2005/0220539 | A1 | | 10/2005 | Yee | |
| 2006/0000561 | A1 | * | 1/2006 | Anderson et al. | 160/168.1 R |

FOREIGN PATENT DOCUMENTS

| | | |
|---|---|---|
| GB | 2374879 | 10/2002 |
| GB | 2390388 | 7/2004 |

* cited by examiner

*Primary Examiner*—Gary S Hartmann
(74) *Attorney, Agent, or Firm*—Bennett Jones LLP

(57) ABSTRACT

The invention is directed to interlocking ground cover mats that can be used to facilitate the passage of heavy equipment and vehicles on wet or disturbed ground. The ground cover mats are comprised of boards contained within a metal frame. The side surfaces of the mats are connected using an interlock member and an interlock opening. The end surface of the mats is connected using a retaining pin that feeds through openings in perpendicular plates, or alternatively using complimentary pins and recesses.

10 Claims, 10 Drawing Sheets

INTERLOCKING GROUND COVER MATS

FIELD OF THE INVENTION

The present invention relates to ground cover mats.

BACKGROUND

In the oil and gas industry, it is sometimes necessary to provide ground cover mats with sufficient strength to support heavy equipment and transport trucks over wet or disturbed ground. It is desirable if such mats interlock in a convenient and secure manner.

A number of prior art ground cover mats exist however, they are frequently difficult and complicated to connect and are expensive to produce. Further, the connection systems frequently fail breaching the structural integrity of the ground cover. What is needed is an improved ground cover mat that is simple and relatively inexpensive, that has sufficient strength to support heavy equipment, and which can be interlocked in a convenient and secure manner.

SUMMARY OF THE INVENTION

The present invention is directed to ground cover mats. In one aspect of the invention, the invention comprises a quadrilateral ground cover mat comprising:

(a) two opposing major surfaces, two opposing end surfaces, and first and second opposing lateral surfaces;

(b) an interlock opening defined by the second lateral surface, wherein said interlock opening has a receiving section, and a locking section;

(c) a interlock member projecting from the first lateral surface, said interlock member having a neck portion and a locking portion;

(d) whereby the interlock member mates with the interlock opening of an adjacent cover mat by inserting the interlock member into the receiving section, and sliding the locking portion of the interlock member laterally into the locking section; and (e) means for releasably engaging the end of an adjacent mat said means disposed on each end surface.

In one embodiment, the mat has a plurality of interlock members project from the first lateral surface and the second lateral surface defines a plurality of interlock openings. In a further embodiment, the opposing major surfaces are defined by a plurality of elongate boards, each board having a substantially rectangular cross-section and disposed such that the vertical dimension is larger than the horizontal dimension, each board parallel to the lateral surfaces. In one embodiment, each board comprises at least one wood layer bonded to at least one composite material layer. In an embodiment of the present invention, the interlock member comprises a flat hook. In another embodiment, each interlock member comprises a pin with an enlarged head.

In one embodiment the means for releasably engaging the end of an adjacent mat comprises a plurality of plates extending from each end surface of the mat in a substantially perpendicular orientation, each plate having an opening for receiving an end retaining rod, the end retaining rod being parallel to the end surface and perpendicular to each lateral surface, and the plates from adjacent end surfaces cooperating to receive common end retaining rod. In a further embodiment, the means for releasably engaging the end of an adjacent mat comprises pins protruding from the end surface in a substantially perpendicular orientation and complimentary recesses in the end surfaces such that the ends of adjacent mats are engaged by inserting the pins of one end surface into the complimentary openings of the adjacent end surface. In one embodiment, the end surface of the mat has a plate adjacent to each lateral surface, each such plate having a tubular member extending outwards from the plate towards, but not beyond, the lateral edges of the mat in an orientation that is parallel to the end surface. In another embodiment, the mat has recesses in one of the major surfaces to allow access to the tubular members. In one embodiment, the mat has at least two passages, each passage each extending from an opening on a major surface proximate to a lateral surface to an opening in said lateral surface.

In another aspect of the invention, the invention comprises a quadrilateral ground cover mat comprising:

(a) two opposing major surfaces, the opposing major surfaces being defined by a plurality of elongate boards, each board having a substantially rectangular cross-section and disposed such that the vertical dimension is larger than the horizontal dimension, each board parallel to the lateral surfaces.

(b) two opposing end surfaces, and first and second opposing lateral surfaces;

(c) an interlock opening defined by the second lateral surface, wherein said interlock opening has a receiving section, and a locking section;

(d) an interlock member projecting from the first lateral surface, said interlock member having a neck portion and a locking portion;

(e) whereby the interlock member mates with the interlock opening of an adjacent cover mat by inserting the interlock member into the receiving section, and sliding the locking portion of the interlock member laterally into the locking section; and (f) means for releasably engaging the end of an adjacent mat said means disposed on each end surface.

BRIEF DESCRIPTION OF THE DRAWINGS

The invention will now be described by way of an exemplary embodiment with reference to the accompanying simplified, diagrammatic, not-to-scale drawings.

DETAILED DESCRIPTION OF PREFERRED EMBODIMENTS

The present invention provides for ground cover mats. When describing the present invention, all terms not defined herein have their common art-recognized meanings. To the extent that the following description is of a specific embodiment or a particular use of the invention, it is intended to be illustrative only, and not limiting of the claimed invention. The following description is intended to cover all alternatives, modifications and equivalents that are included in the spirit and scope of the invention, as defined in the appended claims.

Figure 1:
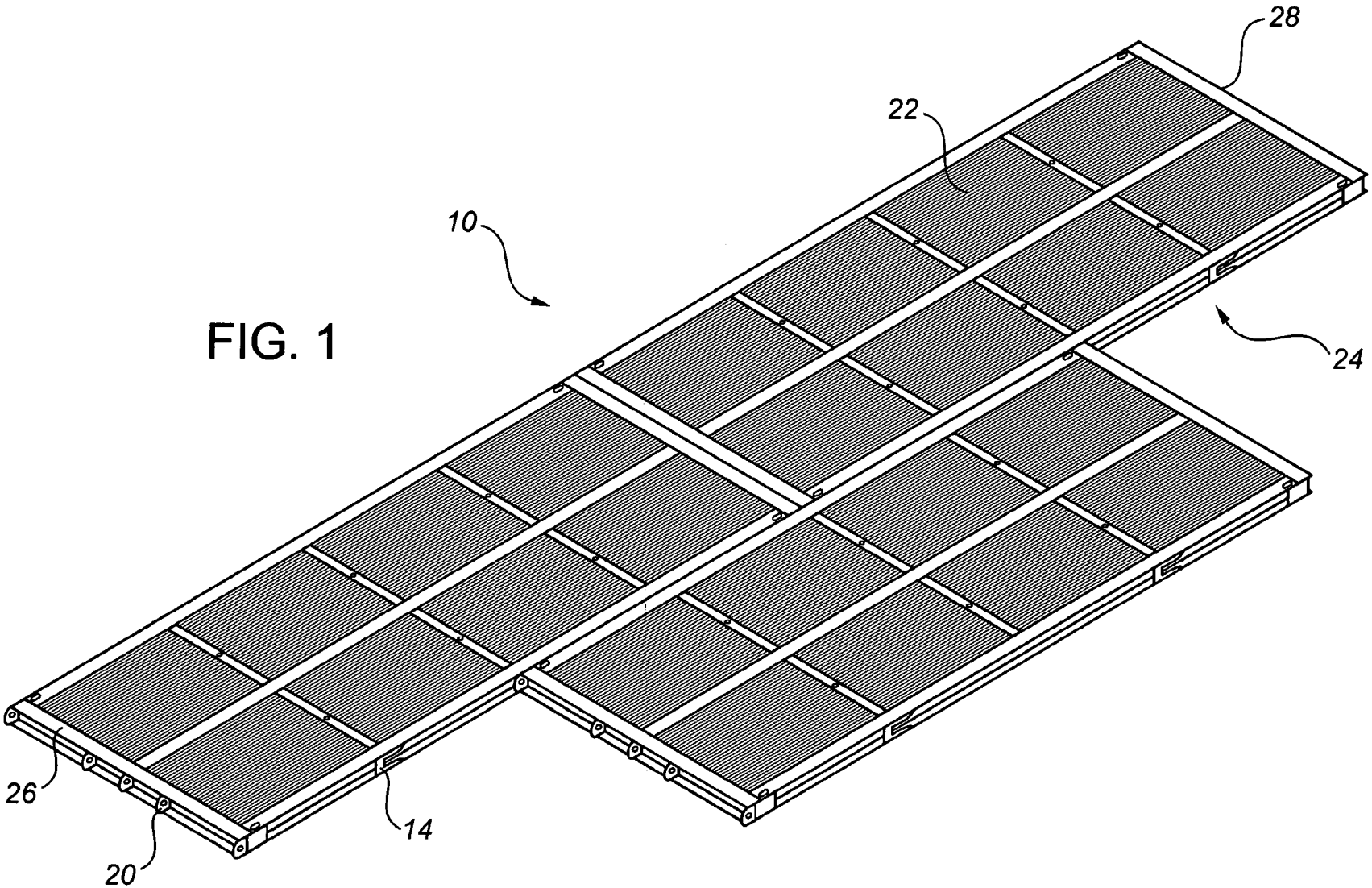
FIG. 1 is a diagrammatic representation of three interlocked mats of one embodiment of the present invention.
Figure 4:
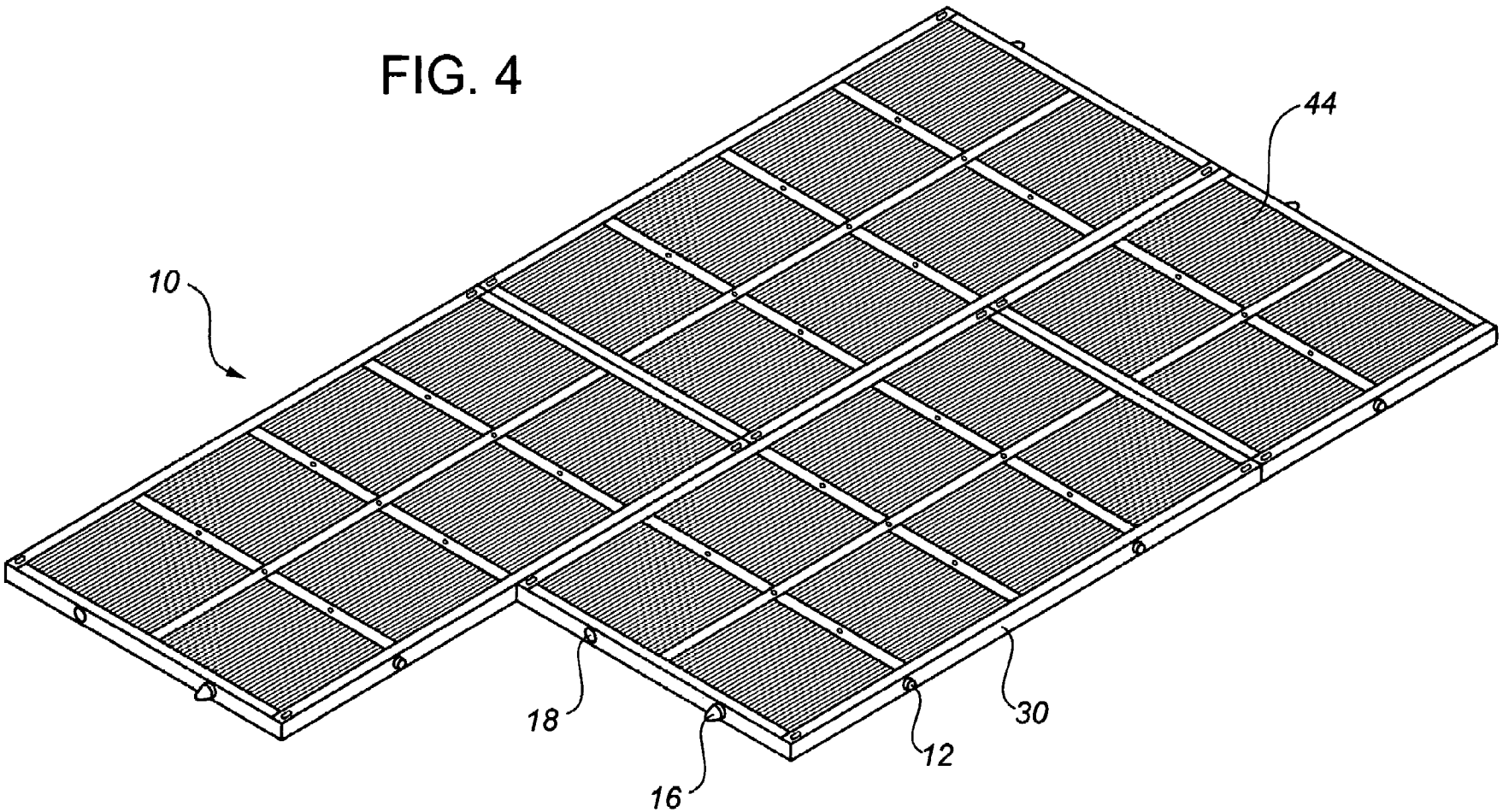
FIG. 4 is a diagrammatic representation of three interlocked mats of one embodiment of the present invention.

The invention will now be described having regard to the accompanying Figures. The mat (10) is comprised of two major opposing surfaces (22 and 24), two opposing end surfaces (26 and 28), a first lateral surface (30) and a second lateral surface (32). As shown in FIGS. 1 and 4, the mats (10) are designed so that they can be releasably interconnected to the lateral surfaces and end surfaces of adjacent mats (10). In this manner the mats (10) may be connected together to the desired area and shape required by the user.

Figure 2:
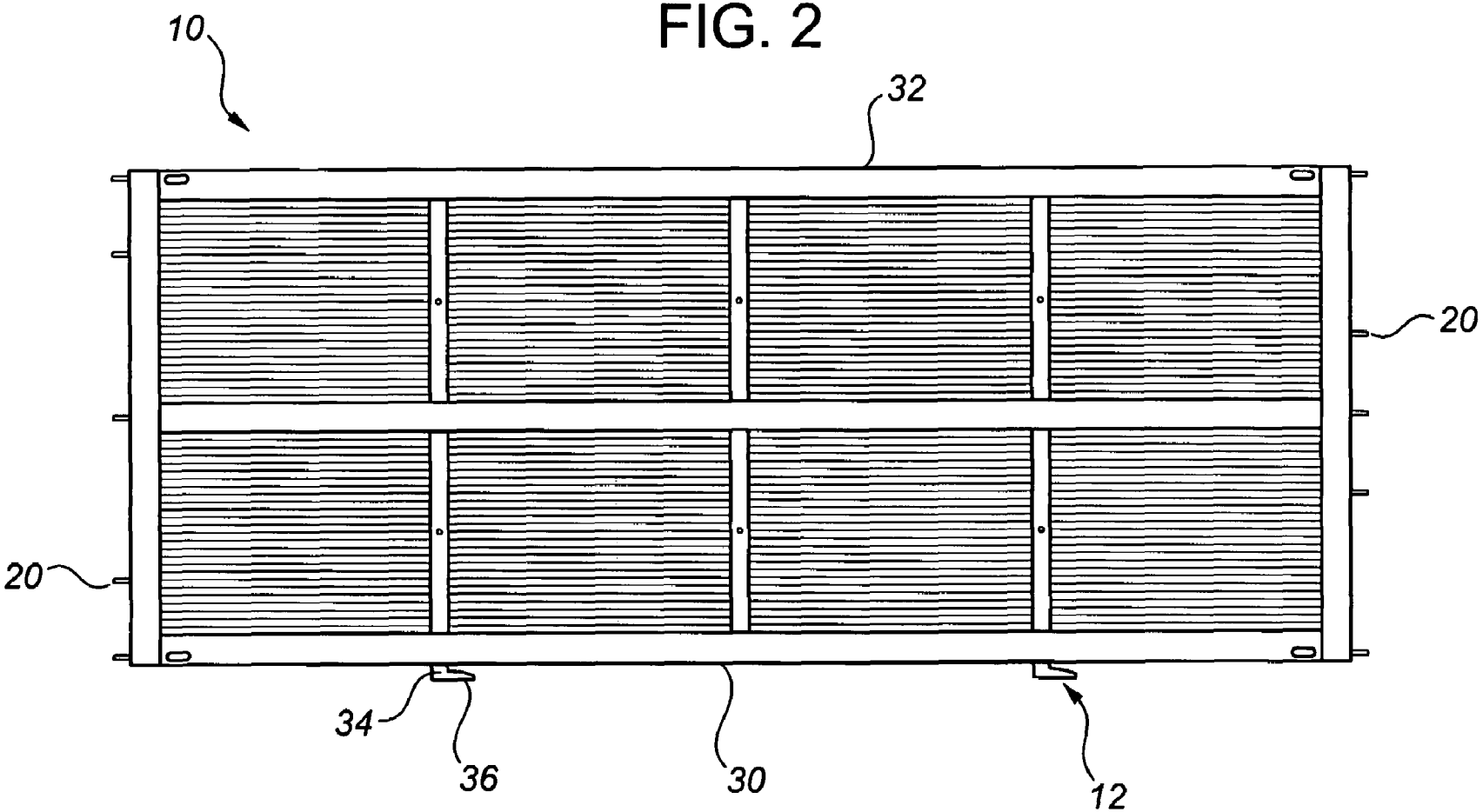
FIG. 2 is a diagrammatic representation of a top view of the opposing surface of one embodiment of the present invention.
Figure 3:
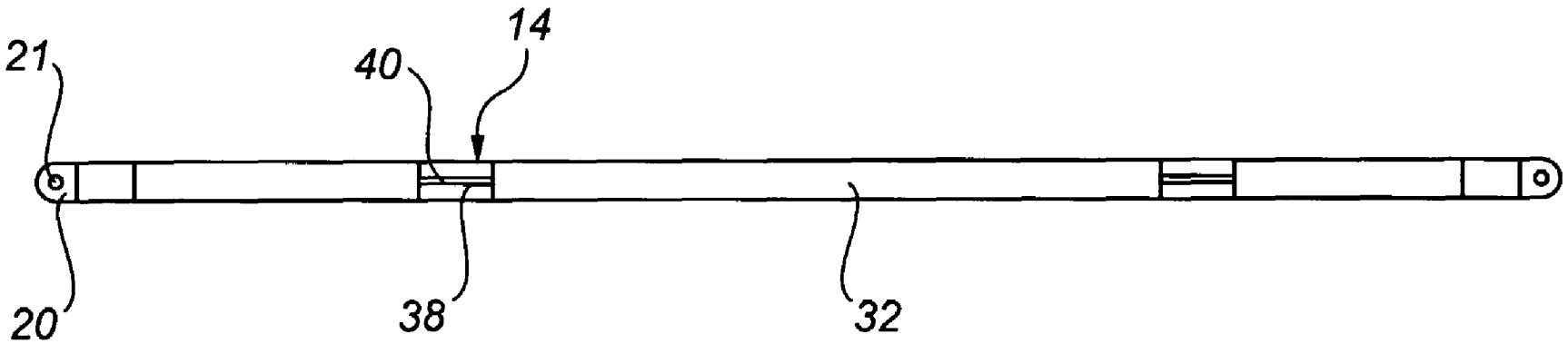
FIG. 3 is a diagrammatic representation of a side view of the lateral surface of one embodiment of the present invention.
Figure 5:
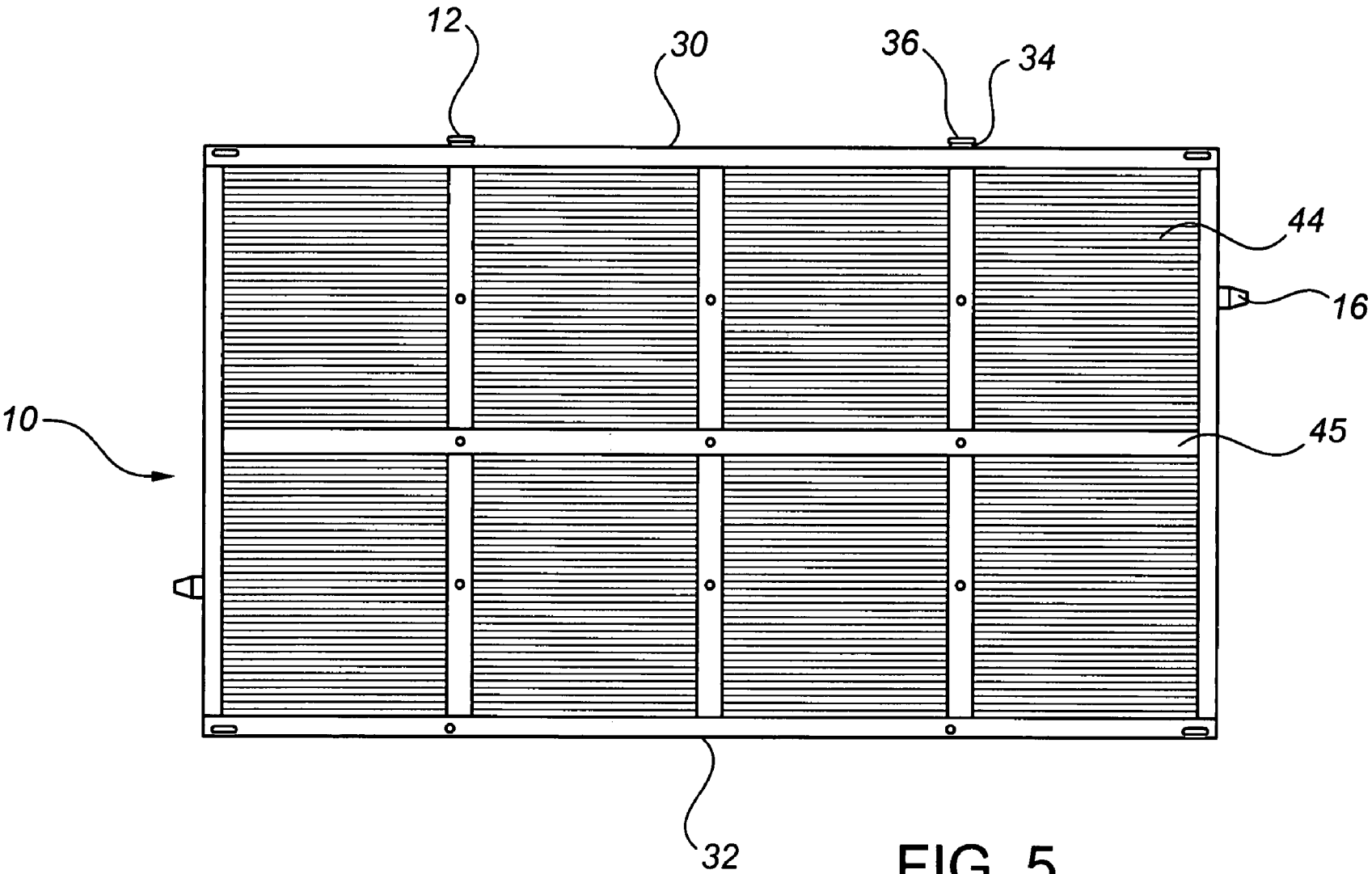
FIG. 5 is a diagrammatic representation of a top view of the opposing surface of one embodiment of the present invention.
Figure 6:
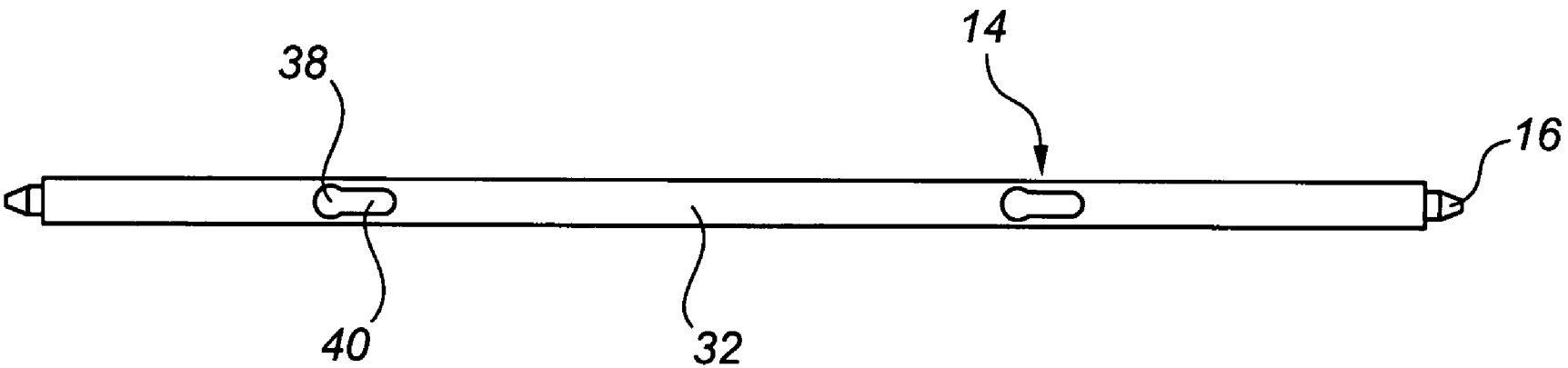
FIG. 6 is a diagrammatic representation of a side view of the lateral surface of one embodiment of the present invention.

Adjacent lateral surfaces are locked together using interlock members (12) and interlock openings (14). The first lateral surface (30) has at least one protruding interlock member (12). The interlock member (12) has a neck portion (34) and a locking portion (36). As shown in FIG. 2 the interlock member (12) may comprise a flat hook, or alternatively it may comprise a pin with an enlarged head as shown in FIG. 5. The second lateral surface (32) defines at least one complementary interlock opening (14). As shown in FIGS. 3 and 6, the interlock opening (14) has a receiving section (38) and a locking section (40) and is shaped to be complementary to the type of interlocking member (12) that is being used. To connect adjacent lateral surfaces of mats (10), the interlocking members (12) are first aligned with interlocking openings (14) on the adjacent mats (10). The interlocking member (12) is inserted into the receiving section (38) of the interlocking opening (14) and is then slid laterally until the locking portion (36) of the interlocking member (12) is engaged in the locking section (40) of the interlock opening (14). One skilled in the art will understand that other suitable combinations of interlock members (12) and interlock openings (14) may be used with the present invention. As shown in FIGS. 1 and 4, it can be seen that the lateral surface of a mat may linked to two lateral surfaces of adjacent mats to form a brick like configuration. This particular configuration is advantageous as it assists with the locking together of the end surfaces (26 and 28).

The mat (10) has two opposing end surfaces (26 and 28) each having a means for releasably engaging the end of an adjacent mat. As shown in FIGS. 1, 2 and 3, the means may comprise perpendicular plates (20) that have an opening (21) to receive an end retaining rod (not shown in the Figures). When the ends of two mats are moved together, the openings (21) of the plates (20) from each end become aligned and an end retaining rod can be threaded through both sets of the openings thereby holding the two adjacent ends together. Once inserted through the openings, the end retaining rod is an orientation that is parallel to the end surfaces (26 and 28) and perpendicular to the lateral surfaces (30 and 32). When the interlocking members (12) are inserted in the interlocking openings (14) of the adjacent mats, there is a gap between the adjacent ends, however as the mat slides laterally to lock the interlock members (12) within the interlock openings (14), the end of the adjacent mats come together and the openings (21) in the plates (20) become aligned. As can be seen in FIG. 1, the plates (20) may be set in a channel so that when adjacent ends are moved together and are linked, the plates extend into the complementary channel of the adjacent end. This allows the adjacent ends to rest against each other thereby increasing structural integrity and reducing gaps between the mats.

As shown in FIGS. 4, 5, and 6, the means for engaging adjacent end surfaces may alternatively comprise a series of perpendicularly protruding pins (16) and complementary recesses (18) in the end surfaces (26 and 28). When the adjacent ends are aligned and moved together through the lateral sliding movement to lock the interlock members (12) in the interlock openings (14), the pins (16) move into the complimentary recesses (18) on the adjacent end. In this manner the adjacent ends are engaged.

The interlock members (12), the interlock openings (14), the pins (16), complementary recesses (18), plates (20) and end retaining pin may be constructed using a suitable metal such as steel, such suggestion not intended to be limiting. Similarly, the lateral surfaces (30 and 32) and the opposing end surfaces (26 and 28) may also be constructed from any suitable material as would be selected by one skilled in the art including metals such as steel.

The opposing surfaces of the mats (10) may be constructed from any suitable material however, in one embodiment the opposing major surfaces are constructed from a plurality of elongate boards (44), each such board having a substantially rectangular cross-section being disposed such that the vertical dimension of the board is larger than the horizontal dimension. As shown in FIGS. 2 and 5, the boards are arranged an orientation that is parallel to the lateral surfaces (30 and 32). As shown in the Figures, the boards (44) are contained within a metal frame (45) that is constructed from any suitable material such as steel. It should be understood that the lateral surfaces (30 and 32) and the end surfaces (26 and 28) form part of the frame. The boards (44) may be single 2×4 or 2×6 boards or may be constructed using wood layers bonded to composite material layers such as fibreglass, however such other materials as are commonly used in the art may also be employed for the boards (44). The boards are preferably laid on end where the vertical dimension is larger than the horizontal dimension, thus increasing the bending strength of the mats (10).

Figure 7:
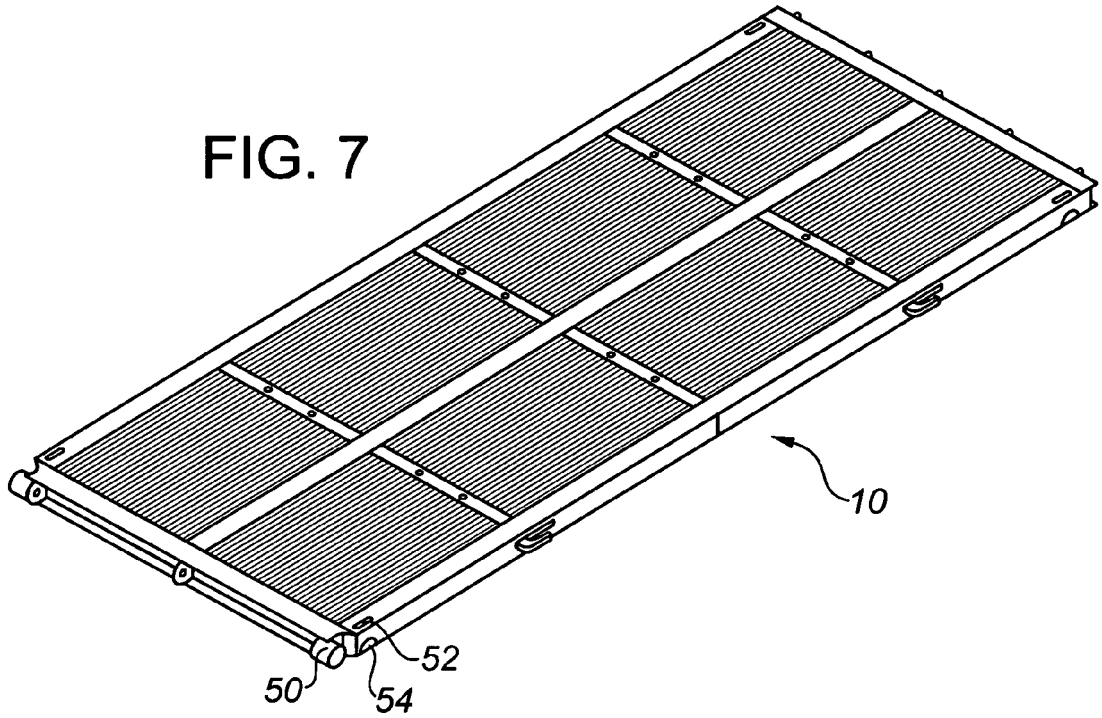
FIG. 7 is a diagrammatic depiction of one embodiment of a mat of the present invention.
Figure 8:
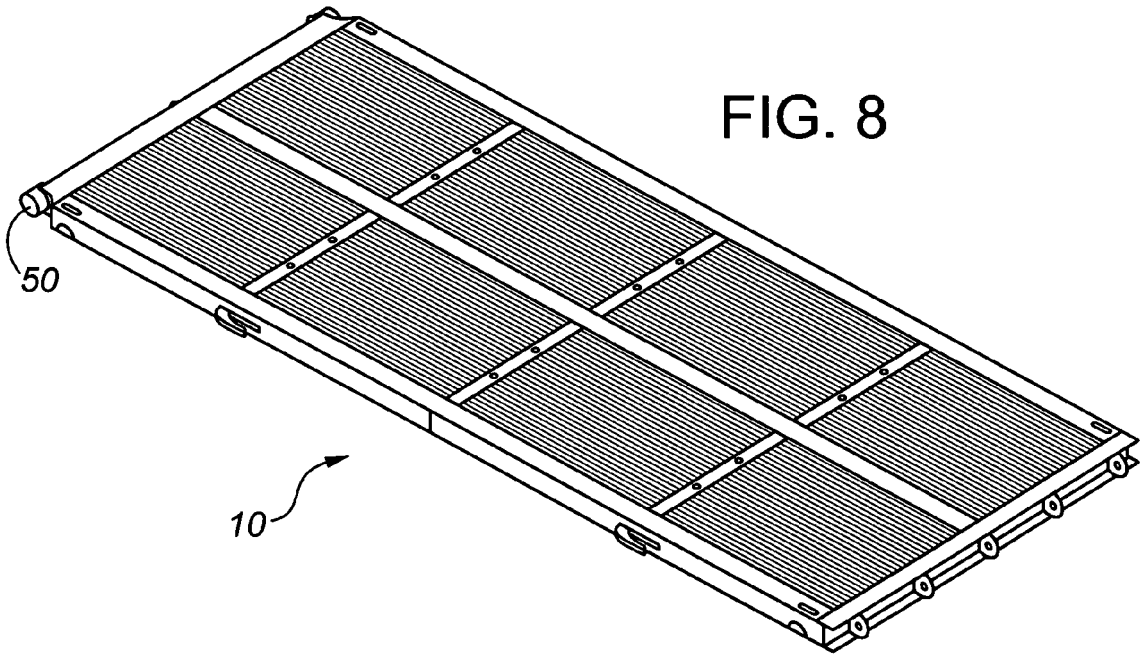
FIG. 8 is a diagrammatic depiction of one embodiment of a mat of the present invention.
Figure 9:
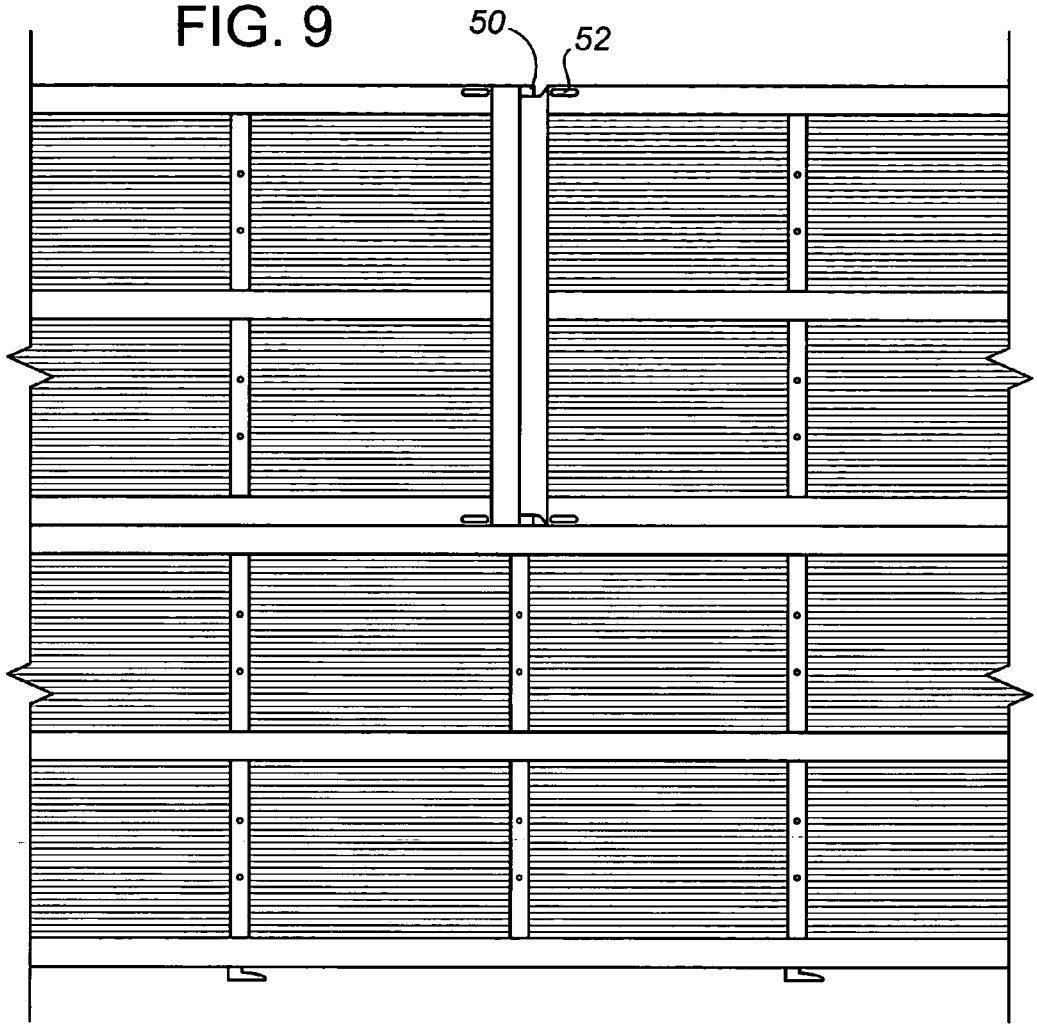
FIG. 9 is a diagrammatic representation of three interlocked mats of one embodiment of the present invention.
Figure 10:
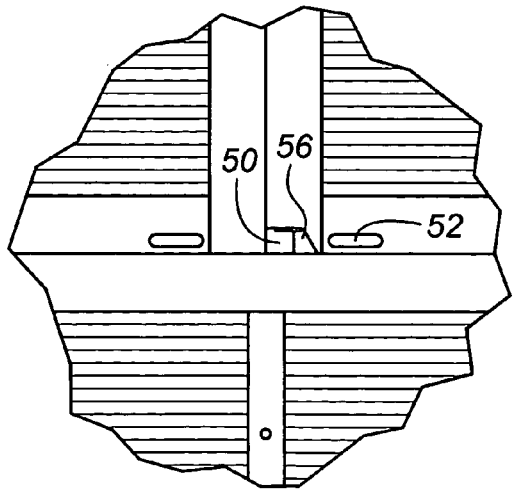
FIG. 10 is a diagrammatic representation of the intersection of the ends of two of three interlocked mats of one embodiment of the present invention.
Figure 11:
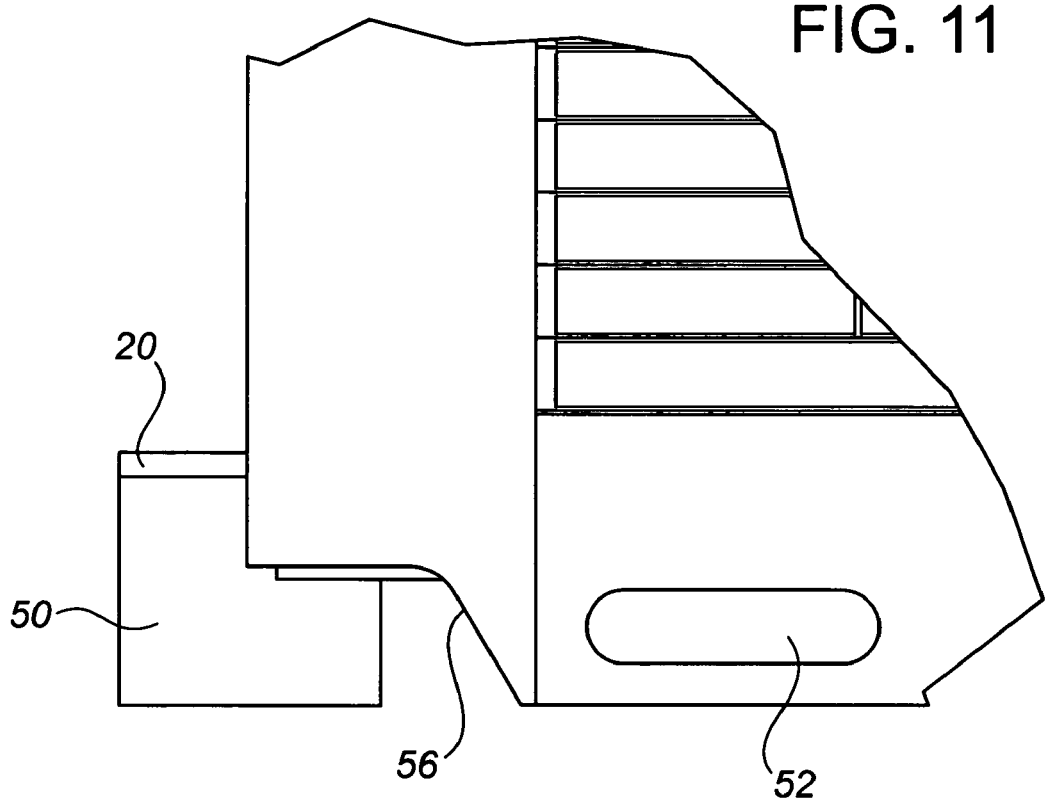
FIG. 11 is a diagrammatic representation of a top view of a portion of an end surface of one embodiment of the present invention.
Figure 12:
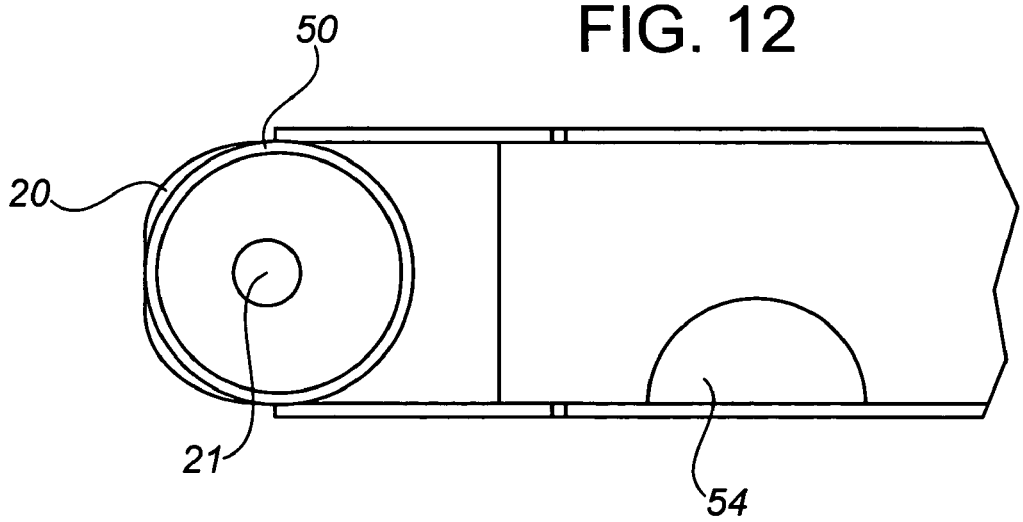
FIG. 12 is a diagrammatic representation of a side view of the end surface and a portion of a lateral surface of one embodiment of the present invention.
Figure 13:
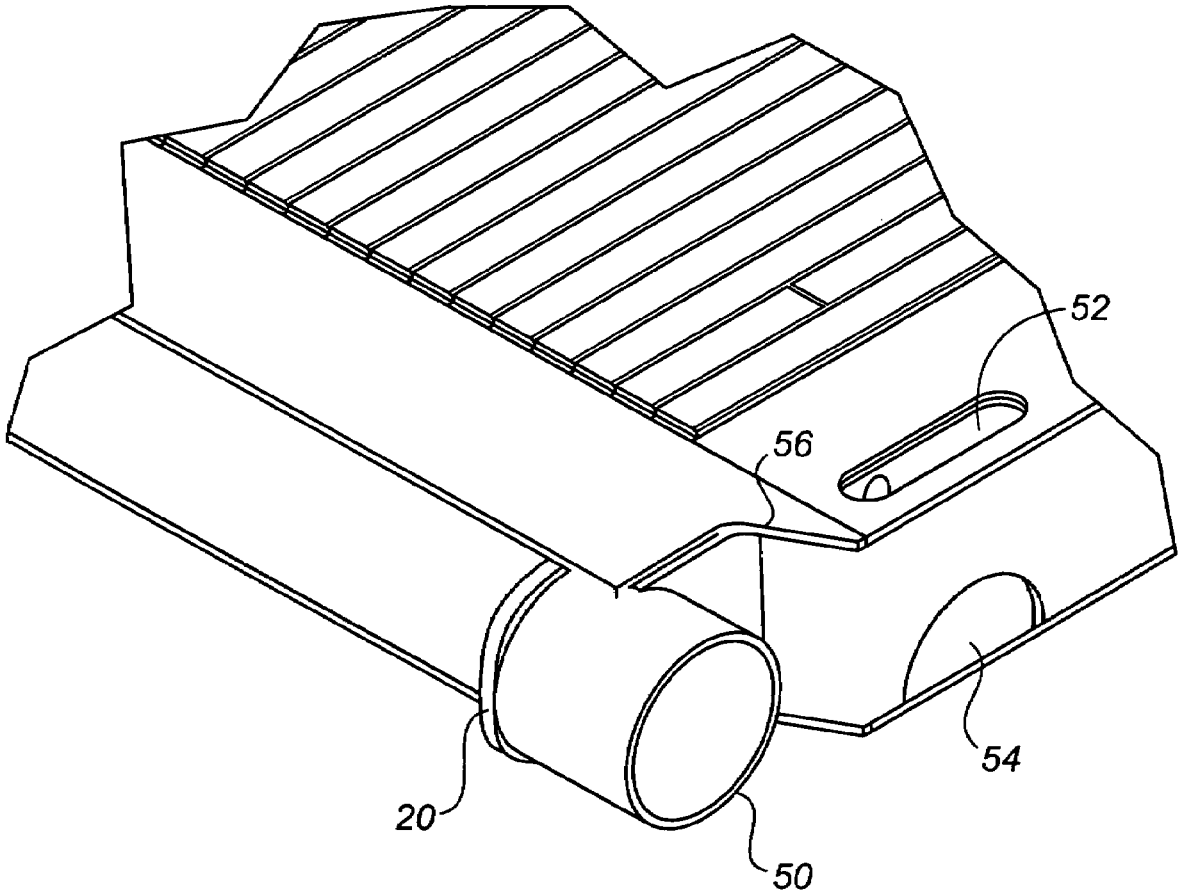
FIG. 13 is a diagrammatic depiction of a portion of an end surface of one embodiment of a mat of the present invention.

The mats of the present invention may be lifted and moved using conventional oilfield equipment. As shown in the Figures, on one of the major surfaces, the metal frame on the lateral surfaces has an opening (52) at each corner. Each opening (52) leads to a passage (54) that exits the lateral surface proximate to the opposing major surface. Chains or cable may be threaded through the openings (52) and corresponding passages (54) to facilitate the use of lifting equipment such as a picker or crane. One end of the mat (10) may also be configured to allow lifting using a sling. The outer most perpendicular plates (20) may have tubular members (50) extending outwards in an orientation that is perpendicular to the lateral surfaces (30,32), and parallel to the end surface as shown in FIGS. 7, 11 and 13. The tubular members (50) terminate before the outside edge of each lateral surface (30, 32) so that they do not impinge on adjacent mats. The end-retaining rod can be inserted into the openings (21) in the perpendicular plates (20) through the hollow center of the tubular member (50). The frame (45) overlaying the tubular members may be recessed (56), as shown in FIGS. 9, 10, 11 and 13, to facilitate access to the tubular members (50). It can be understood that to lift the mat, the sling is looped around the end of each of the tubular members (50) and is then drawn tight.

To detach the mats (10), the relevant end retaining rod is removed, and the mat to be removed is slid laterally until the interlock member (12) moves into the receiving section of the interlock opening (38). The mat (10) to be detached is then pulled away from the adjacent mats in an orientation that is perpendicular to the lateral surfaces of the adjacent mats thereby extracting the interlock members (12) from the interlock openings (14). This process is repeated until all of the mats are detached.

What is claimed is:

1. A quadrilateral ground cover mat comprising:

(a) two opposing major surfaces, the opposing major surfaces being defined by a plurality of elongate boards contained within a frame, each board having a substantially rectangular cross-section and disposed such that the vertical dimension is larger than the horizontal dimension;

(b) two opposing end surfaces, and first and second opposing lateral surfaces, wherein one end surface comprises a tubular member extending towards, but not beyond, the lateral surfaces of the mat in an orientation that is parallel to the end surface;

(c) an interlock opening defined by the second lateral surface, wherein said interlock opening has a receiving section, and a locking section;

(d) an interlock member projecting from the first lateral surface, said interlock member having a neck portion and a locking portion;

(e) whereby the interlock member mates with the interlock opening of an adjacent cover mat by inserting the interlock member into the receiving section, and sliding the locking portion of the interlock member laterally into the locking section; and (f) means for releasably engaging the end of an adjacent mat said means disposed on each end surface.

2. The mat of claim 1 wherein a plurality of interlock members project from the first lateral surface and wherein the second lateral surface defines a plurality of interlock openings.

3. The mat of claim 2 wherein each board comprises at least one wood layer bonded to at least one composite material layer.

4. The mat of claim 1 wherein each interlock member comprises a flat hook.

5. The mat of claim 1 wherein each interlock member comprises a pin with an enlarged head.

6. The mat of claim 1 wherein the means for releasably engaging the end of an adjacent mat comprises a plurality of plates extending from each end surface of the mat in a substantially perpendicular orientation, each plate having an opening for receiving an end retaining rod, said end retaining rod being parallel to the end surface and perpendicular to each lateral surface, whereby the plates from adjacent end surfaces cooperate to receive common end retaining rod.

7. The mat of claim 6 wherein one end surface of the mat has a plate adjacent to each lateral surface, each such plate bearing the tubular member extending towards, but not beyond the lateral surface.

8. The mat of claim 1 further comprising recesses in one of the major surfaces to allow access to the tubular members.

9. The mat of claim 1 further comprising at least two passages, said passages each extending from an opening on a major surface proximate to a lateral surface, to an opening in said lateral surface.

10. The mat of claim 1 wherein the means for releasably engaging the end of an adjacent mat comprises pins protruding from the end surface in a substantially perpendicular orientation and complimentary recesses in the end surfaces whereby the ends of adjacent mats are engaged by inserting the pins of one end surface into the complimentary openings of the adjacent end surface.

* * * * *